US008922387B2

(12) United States Patent
Camwell et al.

(10) Patent No.: US 8,922,387 B2
(45) Date of Patent: Dec. 30, 2014

(54) TAPERED THREAD EM GAP SUB SELF-ALIGNING MEANS AND METHOD

(75) Inventors: Paul L. Camwell, Calgary (CA); David D. Whalen, Calgary (CA)

(73) Assignee: XACT Downhole Telemetry, Inc., Calgary, Alberta (CA)

( * ) Notice: Subject to any disclaimer, the term of this patent is extended or adjusted under 35 U.S.C. 154(b) by 930 days.

(21) Appl. No.: 13/087,020

(22) Filed: Apr. 14, 2011

(65) Prior Publication Data

US 2011/0254695 A1 Oct. 20, 2011

Related U.S. Application Data

(60) Provisional application No. 61/325,492, filed on Apr. 19, 2010.

(51) Int. Cl.
*G01V 3/00* (2006.01)
*E21B 17/00* (2006.01)

(52) U.S. Cl.
CPC ..... *E21B 17/003* (2013.01)
USPC ..... 340/854.6; 340/853.1; 340/854.3; 340/854.4; 324/346; 175/50

(58) Field of Classification Search
USPC ..... 340/854.6, 853.1, 854.3, 854.4; 324/346; 175/50
See application file for complete search history.

(56) References Cited

U.S. PATENT DOCUMENTS

| | | | |
|---|---|---|---|
| 3,268,859 | A | 8/1966 | Watts |
| 3,529,682 | A | 9/1970 | Coyne et al. |
| 3,828,867 | A | 8/1974 | Elwood |
| 3,876,016 | A | 4/1975 | Stinson |
| 3,979,724 | A | 9/1976 | Silverman et al. |
| 4,021,773 | A | 5/1977 | Keenan |
| 4,984,289 | A | 1/1991 | Arakawa et al. |
| 5,070,462 | A | 12/1991 | Chau |
| 5,128,901 | A | 7/1992 | Drumheller |

(Continued)

FOREIGN PATENT DOCUMENTS

WO WO-2009146548 12/2009

OTHER PUBLICATIONS

Drumheller, Douglas S., "Acoustical Properties of Drill Strings", *J. Acoust. Soc. Am.* 85(3), (Mar. 1989),1048-1064.

(Continued)

*Primary Examiner* — George Bugg
*Assistant Examiner* — Naomi Small
(74) *Attorney, Agent, or Firm* — Law Office of Mark Brown, LLC; Mark E. Brown

(57) ABSTRACT

A generally three-part EM gap sub comprising a first conductive cylinder incorporating a male tapered threaded section, a second conductive cylinder incorporating female tapered threaded section, both axially aligned and threaded into each other is described. One or both tapers incorporate slots whereby non-conductive inserts may be placed before assembly of the cylinders. The inserts are designed to cause the thread roots, crests and sides of the tapered sections of both cylinders to be spatially separated. The cylinders can be significantly torqued, one into the other, while maintaining an annular separation and therefore electrical separation as part of the assembly procedure. The co-joined coaxial cylinders can be placed into an injection moulding machine wherein a high performance thermoplastic is injected into the annular space, thereby forming both an insulative gap (the third part) and a strong joint between the cylinders in the newly created EM gap sub.

5 Claims, 9 Drawing Sheets

(56) References Cited

U.S. PATENT DOCUMENTS

| | | | | |
|---|---|---|---|---|
| 5,160,925 | A * | 11/1992 | Dailey et al. | 340/853.3 |
| 5,477,505 | A | 12/1995 | Drumheller | |
| 5,720,354 | A | 2/1998 | Stump et al. | |
| 6,161,630 | A | 12/2000 | Stump et al. | |
| 6,177,882 | B1 | 1/2001 | Ringgenberg et al. | |
| 6,250,402 | B1 | 6/2001 | Brune et al. | |
| 6,320,820 | B1 | 11/2001 | Gardner et al. | |
| 6,435,286 | B1 | 8/2002 | Stump et al. | |
| 6,535,458 | B2 | 3/2003 | Meehan | |
| 6,588,267 | B1 | 7/2003 | Bradley | |
| 6,791,474 | B2 | 9/2004 | Lenz et al. | |
| 6,915,875 | B2 | 7/2005 | Dubinsky et al. | |
| 6,920,943 | B2 | 7/2005 | Mercer et al. | |
| 6,956,791 | B2 | 10/2005 | Dopf et al. | |
| 6,968,909 | B2 | 11/2005 | Aldred et al. | |
| 7,068,183 | B2 | 6/2006 | Shah et al. | |
| 7,228,900 | B2 | 6/2007 | Schultz et al. | |
| 7,252,160 | B2 | 8/2007 | Dopf et al. | |
| 7,605,715 | B2 * | 10/2009 | Clark et al. | 340/854.4 |
| 7,663,373 | B1 | 2/2010 | Gard et al. | |
| 7,900,968 | B2 | 3/2011 | Camwell et al. | |
| 7,958,952 | B2 | 6/2011 | Kusko et al. | |
| 7,997,380 | B2 | 8/2011 | Arian et al. | |
| 8,215,419 | B2 | 7/2012 | Plunkett et al. | |
| 2002/0031050 | A1 | 3/2002 | Blevins et al. | |
| 2003/0006071 | A1 | 1/2003 | Stump et al. | |
| 2003/0076106 | A1 | 4/2003 | Mercer | |
| 2003/0155915 | A1 * | 8/2003 | Kruspe et al. | 324/303 |
| 2006/0131014 | A1 | 6/2006 | Huang et al. | |
| 2007/0039776 | A1 | 2/2007 | Clark | |
| 2007/0153629 | A1 | 7/2007 | Drumheller et al. | |
| 2007/0247328 | A1 * | 10/2007 | Petrovic et al. | 340/853.7 |
| 2007/0257809 | A1 | 11/2007 | Camwell et al. | |
| 2008/0106433 | A1 * | 5/2008 | Madhavan et al. | 340/854.4 |
| 2008/0191900 | A1 * | 8/2008 | Camwell et al. | 340/854.3 |
| 2009/0058675 | A1 | 3/2009 | Sugiura | |
| 2009/0107723 | A1 | 4/2009 | Kusko et al. | |
| 2009/0107757 | A1 | 4/2009 | Lindner et al. | |
| 2010/0282509 | A1 | 11/2010 | Plunkett et al. | |
| 2011/0100712 | A1 | 5/2011 | Poedjono | |
| 2011/0316542 | A1 * | 12/2011 | Frey et al. | 324/339 |
| 2013/0032412 | A1 * | 2/2013 | Haugvaldstad et al. | 175/425 |

OTHER PUBLICATIONS

Young, Warren C., et al., "Roark's Formulas for Stress and Strain", *Case 1*, 7th Edition, McGraw-Hill, (Sep. 13, 2001),p. 592 Section 13.8 Tables, Table 13.1.

Lapeyrouse, Norton J., "Formulas and Calculations for Drilling, Production, and Workover", 2nd edition, 2002, Gulf Professional Publishing, an imprint of Elsevier Science, Conversion of specific gravity to mud weight, pressure gradient,(2002).

Grover, Wayne D., et al., "Development and Performance Assessment of a Distributed Asynchoronous Protocol for Real-Time Network Restoration", *IEEE Journal on Selected Areas in Communications,* (Jan. 1991),9(1): 112-125.

Besaisow, A. A., et al., "Development of a Surface Drillstring Vibration Measurement System", *60th Annual Technical Conference and Exhibition of the Society of Petroleum Engineers,* Las Vegas, NV, (Sep. 22, 1985),pp. 1-14.

Besaisow, A. A., et al., "Application of ADAMS (Advanced Drillstring Analysis and Measurement System) and Improved Drilling Performance", *IADC/SPE Drilling Conference,* Houston, TX, (Feb. 27, 1990),pp. 717-722.

Barnes, et al., "Passband for Acoustic Transmisssion . . . Drill String", *Journal Acout. Soc.of Amer.,* vol. 51, #5, (1972),pp. 1606-1608.

Squire, et al., "A new Approach to Drill-String Acoustic Telemetry", SPE of AIME, SPE 8340, (Sep. 1979).

Drumheller, Douglas S., "Wave Impedances of Drill Strings and Other Periodic Media", *J. Acoustical Society of America,* vol. 112, issue 6, (2002),2527-2539.

"Schlumberger Oilfield Glossary entry for "bottomhole assembly"", www.glossary.oilfield.slb.com, accessed Feb. 22, 2012.

* cited by examiner

TAPERED THREAD EM GAP SUB SELF-ALIGNING MEANS AND METHOD

This application claims priority in U.S. Provisional Patent Application No. 61/325,492, filed on Apr. 19, 2010, which is incorporated herein by reference.

BACKGROUND OF THE INVENTION

1. Field of the Invention

The present invention relates generally to a telemetry apparatus and more particularly to electromagnetic (EM) isolation gap sub devices as used in well drilling and production (e.g. oil and gas) industry.

2. Description of the Related Art

EM telemetry is one method of communication used, for example, when exploring for oil or gas, in coal bed methane drilling and in other drilling applications. In a typical drilling environment EM carrier waves from an EM telemetry device are modulated in order to carry information from the device to the surface. Upon arrival at the surface, the waves are detected, decoded and displayed in order that drillers, geologists and others helping steer or control the well are provided with drilling and formation data.

EM telemetry is well understood as a downhole to surface means of communication. The carrier is normally established by producing an oscillating current across an electrically insulating gap in an otherwise continuous section of steel pipe located close to the drill bit. This current typically follows an electrical return path via the drilling fluid and the nearby associated earth formations. A small fraction of the formation current is detected at surface using an electrically short antenna as one node and the metal of the rig as the other, the signal between these two being amplified and filtered before being decoded and displayed as useful data.

A significant issue in the generation of downhole current is the structural integrity of the gap sub. It must be strong enough to withstand the rigours of the drilling environment local to the bottom hole assembly (BHA)—high torque, vibration, temperature and pressure—to name but a few. The gap sub must also be electrically discontinuous in order that a significant fraction of the generated current is preferentially forced to follow a path within the earth formations. Any reduction in this fraction will reduce the signal amplitude at surface. Thus the electrical discontinuity must be effective whilst retaining sufficient strength to cope with all of the severe mechanical stresses without undue wear or breakage.

Early gap sub designs and their precursors were simple and yielded poor performance by today's standards. Typical of a mechanical means of producing an insulated gap between two metal pipes is taught by McEvoy, U.S. Pat. No. 1,859,311 whereby two tapered male threaded pipes are joined by a short complementary female threaded tube. The problem addressed was the electrolytic corrosion of such pipes, and in particular corrosion of their threads when in the presence of oil and gas well drilling fluids containing contaminants such as acids, sulphur and salts. The solution was to isolate the threads of the pipes from each other by means of a thin coating of an electrically-insulating material applied to the threads. A similar problem associated with the corrosion of sucker rod threads was discussed by Goodner, U.S. Pat. No. 2,940,787, which discloses a similar electrically-insulating solution using materials such as epoxies, phenolics, rubbers, alkyds, all with high dielectric strength, but with the augmentation of an anti-rotation frictional retaining means between adjacent rods.

Another type of insulative gap between pipes and other such tubular members used for drilling or the production of oil or gas in drilled wells is exemplified by Krebs, U.S. Pat. No. 4,015,234, which shows a means by which a time-controlled switch contained within a drill pipe can cause current to flow in the nearby earth formations while drilling a well for producing a telemetry signal originating downhole and of such magnitude that it can be detected at surface. This patent teaches a means and method to implement a simple form of EM telemetry via the placement of pads or annular rings within the external wall of a drill rod, these being the electrical conductors that enable the discharge of a capacitor into the earth. The conductors are insulated from each other and the drill rod by an electrically-insulating material.

A further type of mechanical means for developing an EM telemetry signal downhole is typified by a much more complicated gap sub as taught by Logan et al., U.S. Pat. No. 6,050,353, which shows providing EM gap subs incorporating insulative and anti-rotation means that have a multiplicity of parts and subassemblies comprising metal, rubber, plastic and epoxy in an effort to exclude high pressure (up to about 20,000 psi) drilling fluid from the gap. This design tended to be expensive and difficult to build, and required frequent maintenance.

The improvement of dielectric insulating plastics that combine ease of use, high strength, high adhesion, corrosion resistance and excellent performance at high temperatures (150° C. and above) enabled a significant simplification in EM gap sub design. For example, Camwell et al., U.S. Pub. No. 2008/019190, teach that an extremely simple and practical gap sub comprising a single male tapered coarse thread cylinder coaxially threaded into a complementary single female tapered thread cylinder, said threaded sections being separated by an injection-moulded thermoplastic (such as polyetherimide, polyethylethylketone, polyetherketone or the like) will have adequate strength to resist the rigors of modern oil and gas drilling environments. The efficacy of such a design, based on McEvoy U.S. Pat. No. 1,859,311 and Goodner U.S. Pat. No. 2,940,787, relies on the strength of modern stainless steels and modern thermoplastics as well as its simplicity—the gap sub being basically a three-component device, comprising two conductive cylinders separated by a coaxial dielectric cylinder. The devices use simple anti-rotation means being implemented by machining grooves and the like into the threaded sections, and relying on the high mechanical stress performance of the thermoplastic being able to resist relative torque between the threaded sections, once the sub is thermally cured after injection.

It is in the assembly of such a sub that difficulties arise. FIGS. 1 and 2 of US patent application 2008/0191900 A1 show the two overlapping threaded sections electrically separated by the dielectric material. To inject the dielectric the two conductive cylinders must be held within an injection moulding machine. Furthermore, the two conductive cylinders must be mutually threaded but must not touch in order that the injected plastic is able to form an effective insulative barrier with respect to the two cylinders. To this end the cylinders must be held mutually parallel, coaxial, threadably overlapping but ideally with the threads axially and radially spaced equally apart. These constraints form a significant mechanical fixturing complexity and require a tedious alignment and fixturing procedure. Yet further, the injection process is typically performed at 20,000 psi, and such pressures produce large axial and radial forces on the cylinders. Substantial means must therefore be employed to clamp both cylinders accurately and immovably within the mould such that lack of perfect simultaneous and symmetrical plastic injection through the various sprue passages in the mould do not move one conductive cylinder with respect to the other and cause an electric connection, thereby defeating the purpose of the gap in the sub.

SUMMARY OF THE INVENTION

It is an object of the present invention to significantly improve the manufacturability of tapered thread gap sub designs that rely on a dielectric material (e.g. epoxy, injection-moulded high strength plastic etc.) whose function, in part, is to keep the tapered sections electrically isolated. More specifically, it is an object of the present invention to optimally space the threaded sections both radially and axially before the dielectric material is incorporated into the gap sub members.

Our invention enables the relative juxtaposition of the two threaded members to be accurately placed without recourse to generally expensive and complicated external spacing jigs, fixtures and/or electrical measuring techniques to otherwise confirm correct placement prior to the injection of the dielectric material. This is achieved by modifying a section of the threads in one or both the tapered sections such that plastic inserts or similar insulative means can be inserted in order to prevent the thread crests in one tapered section from directly touching the thread roots in the other tapered section; likewise the inserts also prevent the sides of any thread on one tapered section from directly touching the sides of any thread in the other tapered section. Thus one tapered section can be screwed directly into the other until thread/insert spatial interference is achieved and the tapered sections are fully engaged without direct conductive contact. No special jigs or alignment tools are required, no insulation-testing procedures are necessary, and relatively unskilled personnel can be used for the assembly procedure. It is also an object of the invention that use of the inserts within the tapered sections cause said sections to be self-aligned one to the other, finally achieving optimal alignment when fully engaged. An advantage of such a means and method is that the process automatically aligns and correctly spaces the two threaded members before insertion of same into a simple mould within a plastic-injection machine.

It is a further object of the invention that the method of alignment and spacing of the two threaded members is simply achieved by placing the plastic inserts in one or both of the members and threadably rotating one into the other, achieving ideal alignment and spacing when the torquing force suddenly rises, thereby indicating full and accurate engagement.

The means and method as described herein also has the advantage that the metal threads from one member overlap into the metal threads of the other, thereby forming a fail-safe device that prevents the two sections from parting under tension should the dielectric material fail downhole in some manner.

In summary, the innovative simplification and cost reduction means and method for mechanically joining while electrically separating two threaded tapers on conductive cylinders described here improves the present state of the art of building and aligning EM gap subs prior to their more substantial connection via the injection of a high strength dielectric material within their common annular gap.

It is not intended that an exhaustive list of all such applications be provided herein for the present invention, as many further applications will be evident to those skilled in the art. A detailed description of exemplary embodiments of the present invention is given in the following. It is to be understood, however, that the invention is not to be construed as limited to these embodiments.

BRIEF DESCRIPTION OF THE DRAWINGS

In the accompanying drawings, which illustrate the principles of the present invention and an exemplary embodiment thereof.

DETAILED DESCRIPTION OF THE PREFERRED EMBODIMENTS

Figure 1:
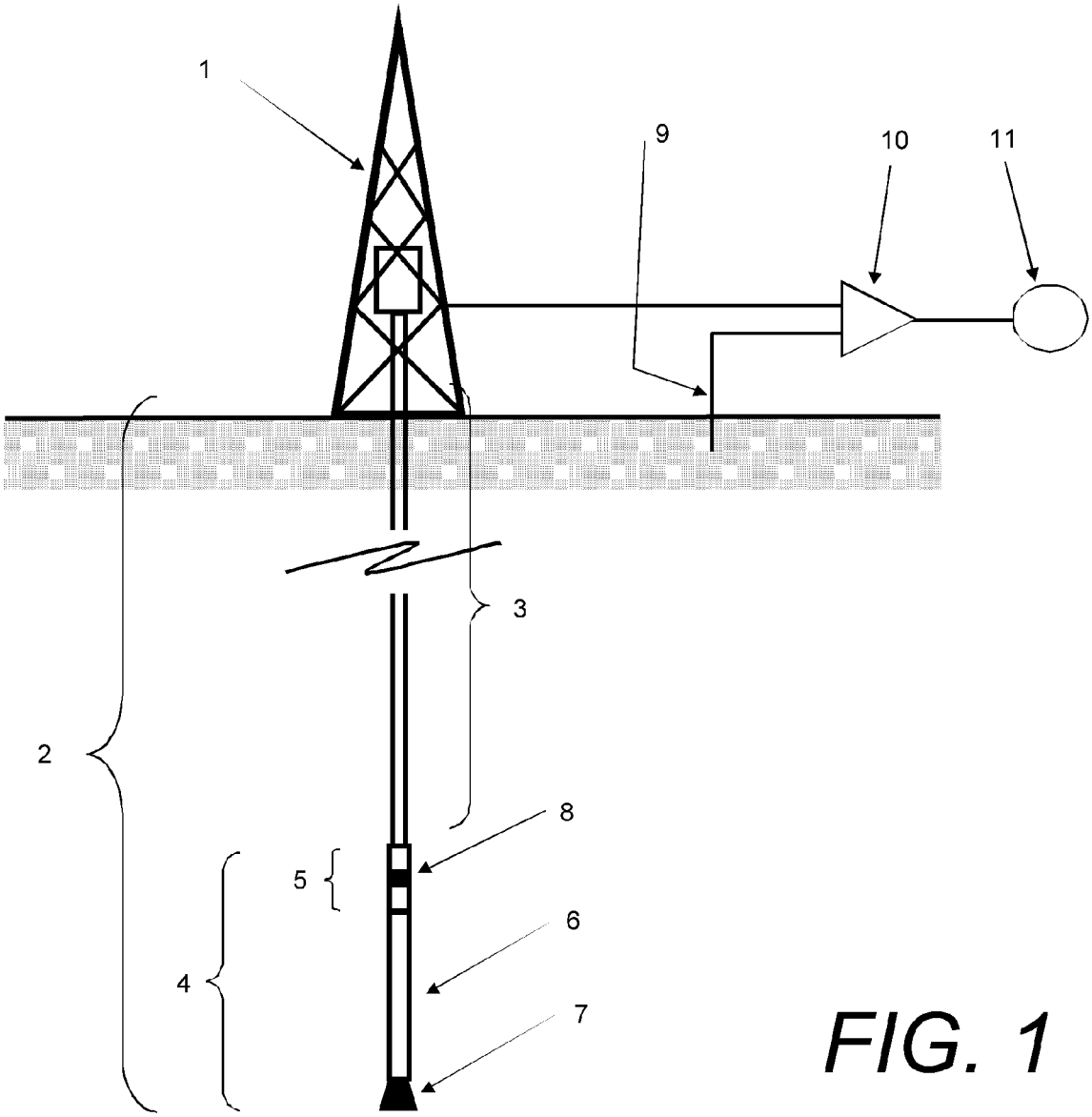
FIG. 1 is a diagram of a typical drilling rig, including an EM telemetry isolation system embodying an aspect of the present invention.

FIG. 1 is a simplification of a typical drilling rig employing an EM telemetry method of transponding drilling parameters from downhole to surface. The derrick 1 supports and drives the jointed pipe drill string 2 that is required to drill a well. The drill string comprises a number of tubular members (drill pipes 3) and a bottom hole assembly (BHA) 4. The BHA 4 in this embodiment comprises an EM gap sub and telemetry device 5, a mud motor 6 and a drill bit 7. As the mud motor 6 rotates the drill bit 7 and the well progresses it is necessary to record various drilling parameters to help the driller safely guide the well. These parameters are gathered and encoded onto an EM carrier that is electrically produced across the insulation gap 8 of the EM gap 5. A tiny fraction of this signal is detected at the surface by the measuring the signal formed between the rig's derrick 1 and a surface antenna 9 located in the ground some distance away (typically about 50 m, dependent on surface resistivity). The signal is amplified by an amplifier 10 and decoded and displayed on an output device 11 as required by the driller and others. It is thus apparent that the gap sub in such environments must be robust enough to withstand the forces of compression, tension, bending, torque, shock and vibration, high temperature and pressure associated with the drilling environment. The dynamic forces applied through the gap sub must be withstood generally throughout the bulk of the insulation material in the annular space between the two overlapping conductive cylinders, as will be shown later. It is only with the advent of modern high strength plastics, and basic design concepts as anticipated by the early work of McEvoy, Goodner and others, that it is possible to make the present generation of EM gap sub designs simpler, stronger, greatly cost-reduced and much more reliable than hitherto.

Figure 2:
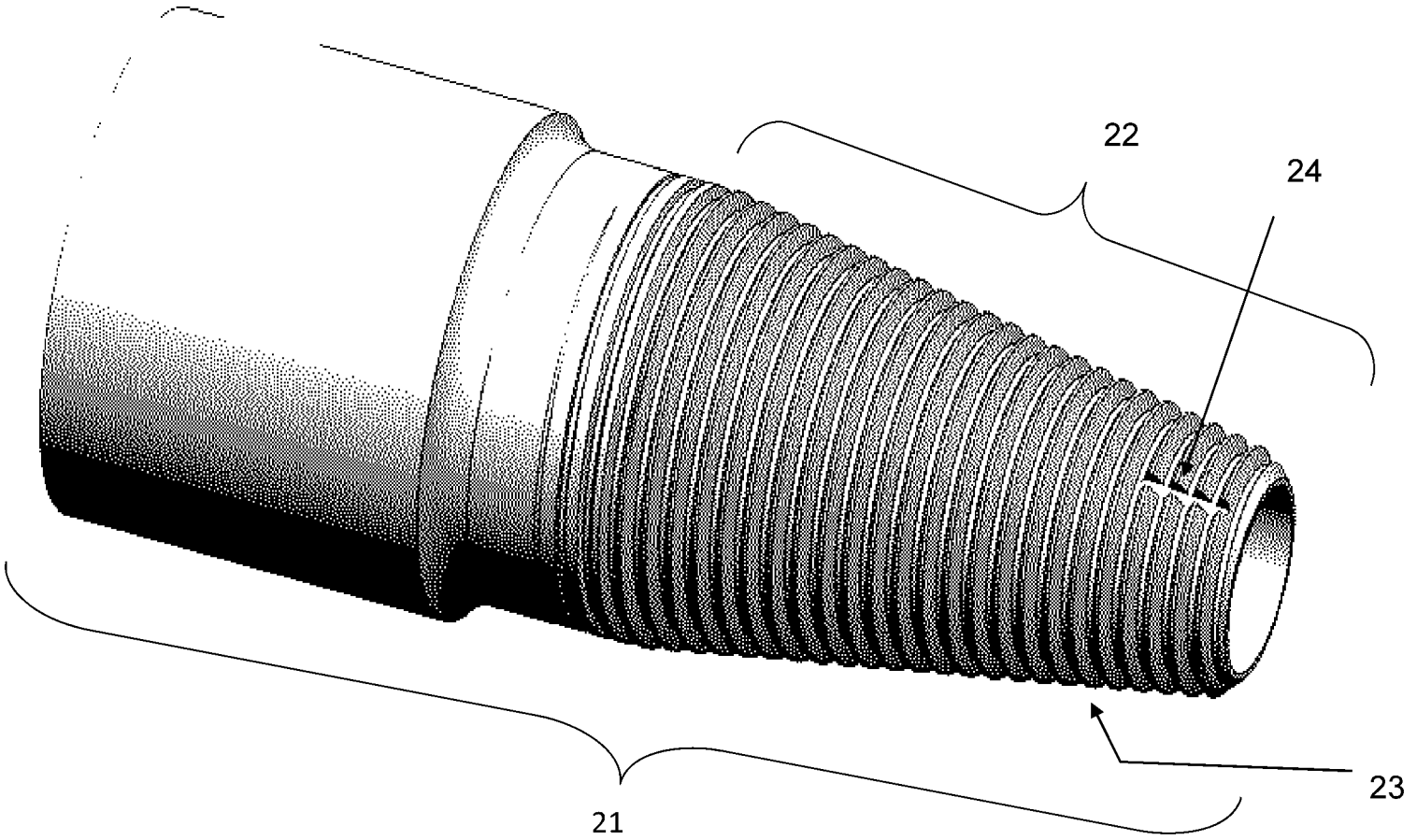
FIG. 2 is an exemplary representation of a coarse threaded male taper section of a metallic cylinder. It shows a short slot cut into a section of threads whereby an insert may be placed.
Figure 3:
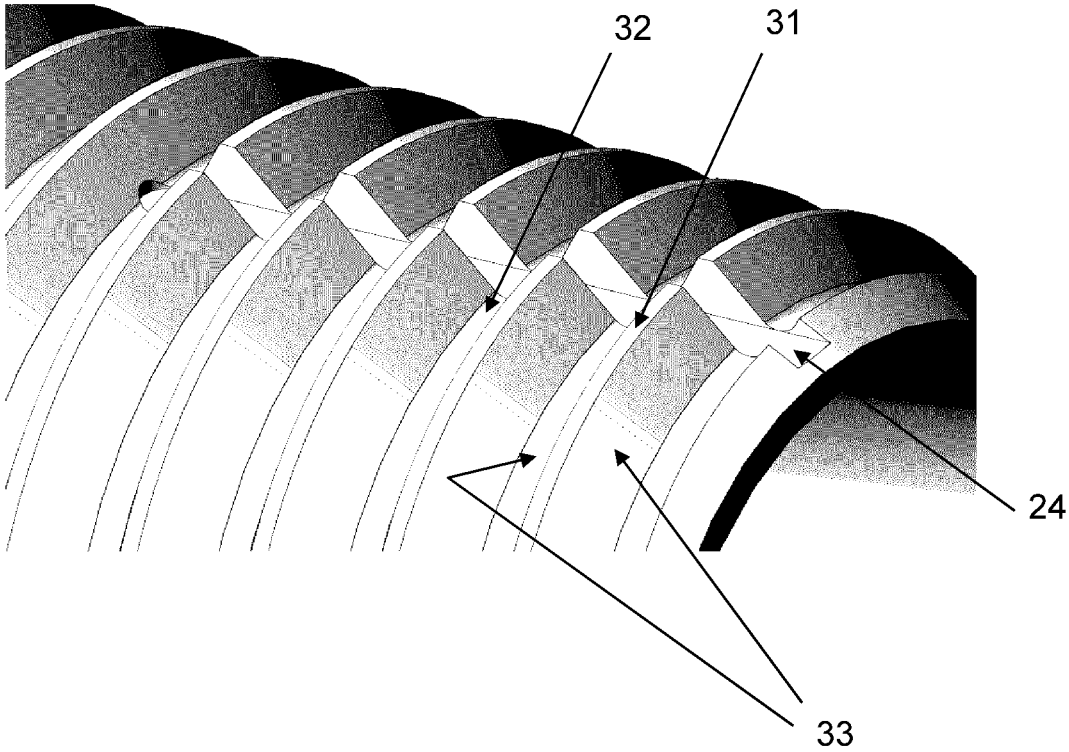
FIG. 3 shows in closer detail a short slot cut into a section of threads, as in as in FIG. 2.

FIG. 2 is a representation of a conductive metal cylinder 21 with a tapered end 22 in which a coarse thread 23 is cut. Also shown in this exemplary description is a short axial slot 24 that is necessary to hold a plastic insert. It will be understood that this male cylindrical section will be joined to a complementary female section to form the two conductive parts of the gap sub. FIG. 3 indicates in more detail an embodiment of the slot 24 that is defined by the removal of metal in an axial direction along the cylinder between several thread crests 31 and thread roots 32.

Figure 4:
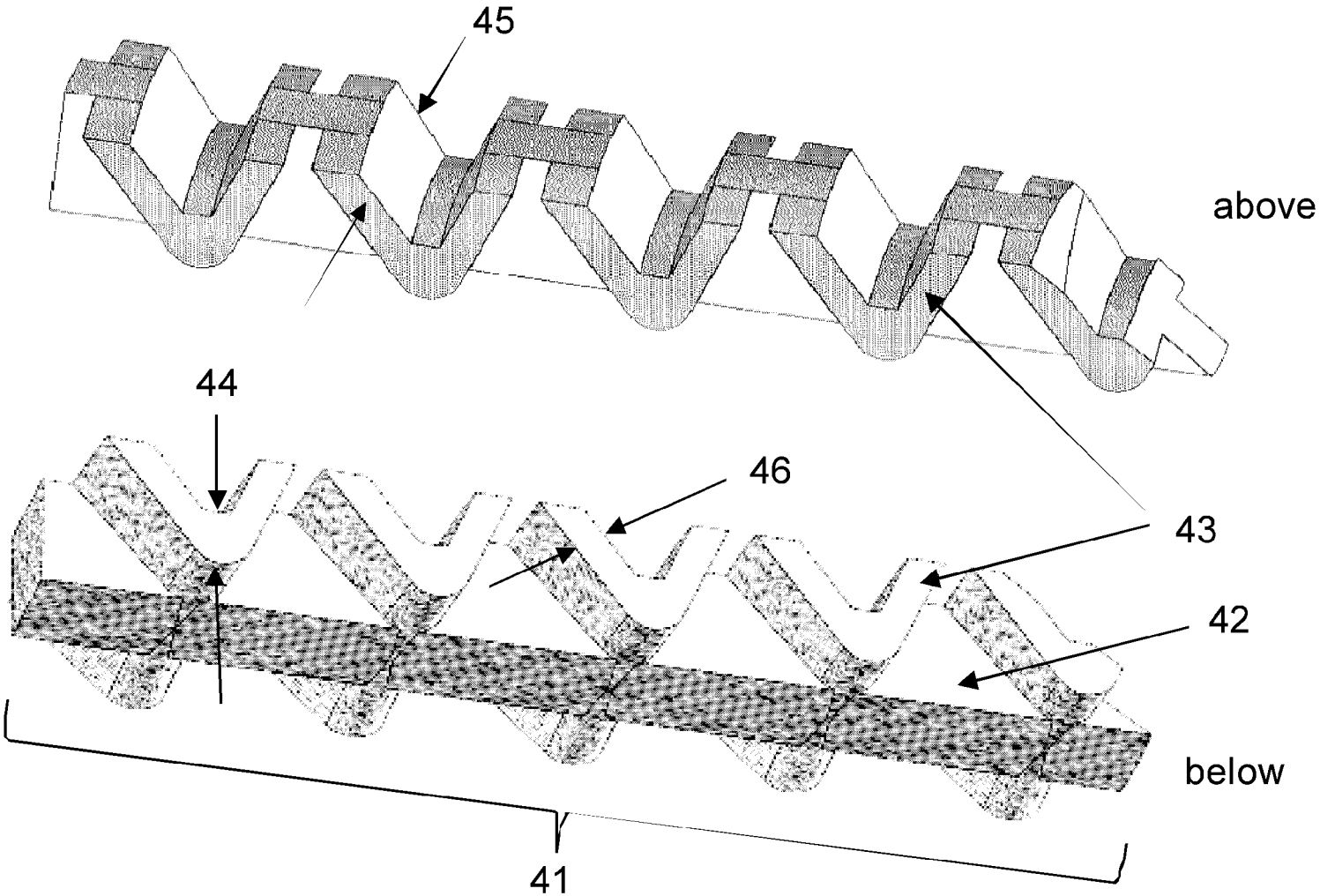
FIG. 4 is an exemplary representation of a plastic insert that would be inserted in a slot as shown in FIG. 3, viewed from above and below.

The next step is to show how a plastic insert may be formed that will fill the slot 24 in such a manner that will keep the threads as a whole on the female tapered section from touching the threads on the male tapered section 22. This is indicated by FIG. 4, whereby the plastic insert 41 (shown from both above and below) comprises an axial runner 42 interspersed with short circumferential thread form extensions 43. It is seen that the thread thickness 44 of the thread form 43 can keep the crests of the threads of the complementary female threads from touching the roots of the male threads. Further, the width of the thread form 45 is wider than the slot 24, thereby extending into the circumferential channels formed by the threads. The wall thickness 46 of the thread form will be seen to hold the thread sides 33 (FIG. 3) on the male and female tapered sections away from each other.

Figure 5:
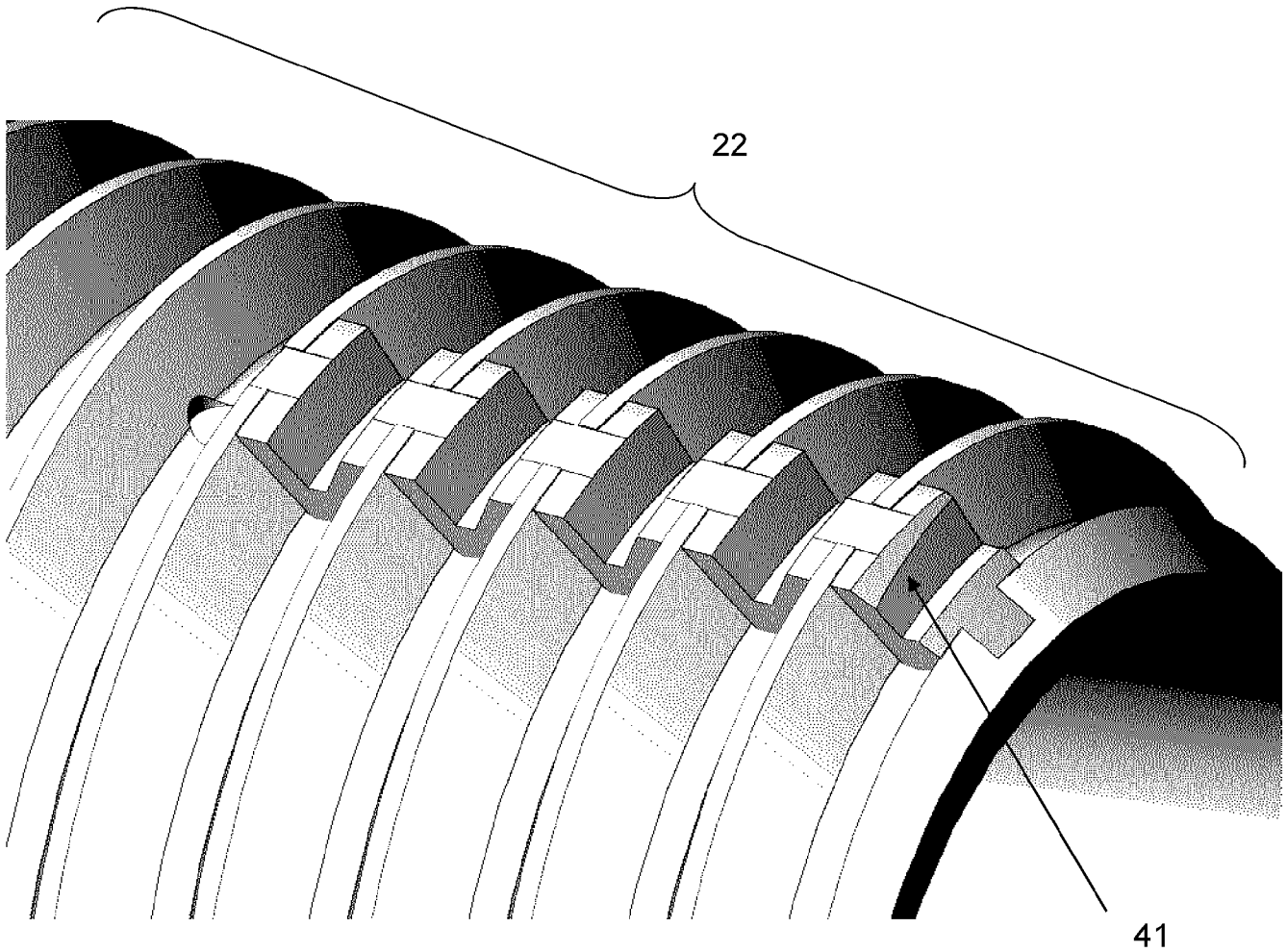
FIG. 5 shows the insert placed in a slot.

These attributes can more be easily seen in FIG. 5. Because we cause the threads in the female section to be similarly dimensioned as the male section thread, the thread roots of the female section (not shown here) will be held away from the thread crests of the male section by the distance defined by thickness 44 of the thread form 43. The thread crests of the female tapered section (not shown) cannot engage with either the thread roots 32 of the male section or the thread sides 33, thus it is evident that, along this insert length at least, the two conductive cylinders are held apart in a spatially controlled manner.

Figure 6:
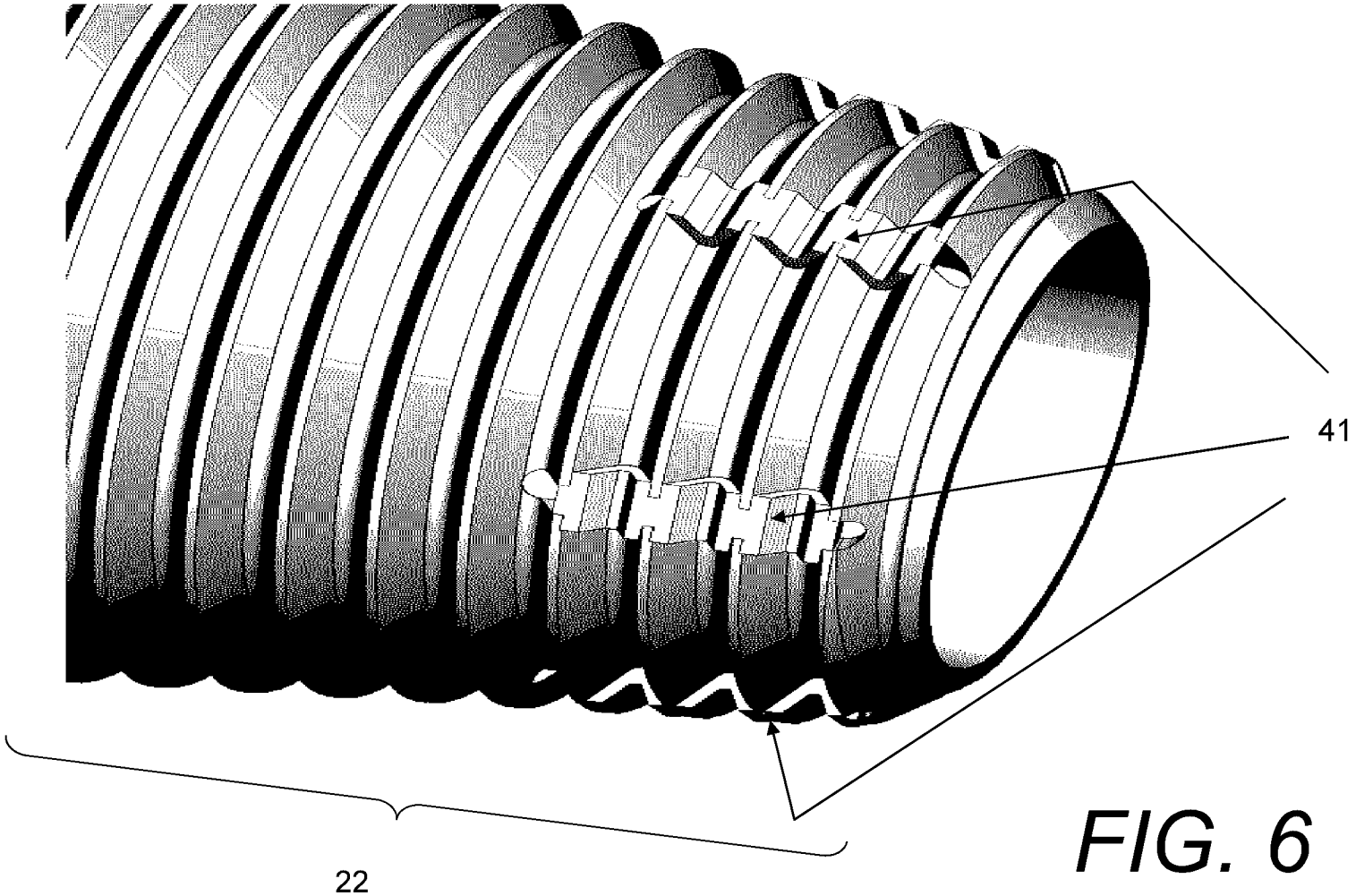
FIG. 6 shows insert inserted into slots disposed around the distal end of a male tapered section.
Figure 7:
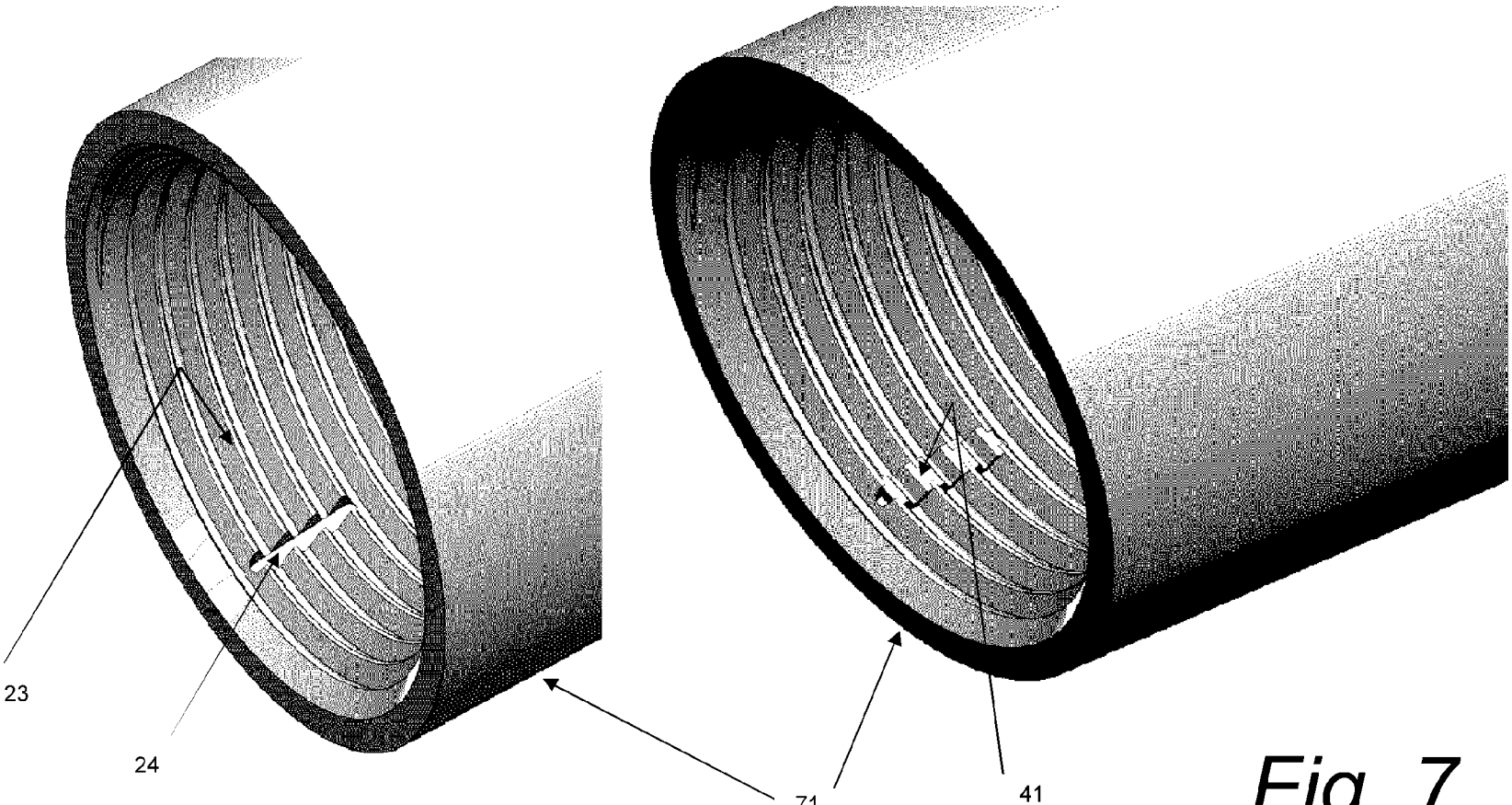
FIG. 7 shows both a slot and an insert placed within a slot at the distal end of a female tapered section.

Three or more inserts 41 can be disposed in generally equally-spaced slots at the tapered distal end 22 of the cylinder 21, as indicated in FIG. 6. This end now holds the narrow tapered end radially away from the threads of the female section. Similar slots and accompanying inserts 41 could be machined in the wide section of the taper such that the tapered sections of both male and female cylinders 21 will be held radially away from each other when fully engaged. Equivalently one can consider implementing slots 24 being milled into the wide section of the taper in the female section 71, as depicted in FIG. 7. From the foregoing one would incorporate several generally equidistant slots with inserts 41 being disposed at the proximal and distal ends of the tapered section of the female cylinder 71.

Figure 8:
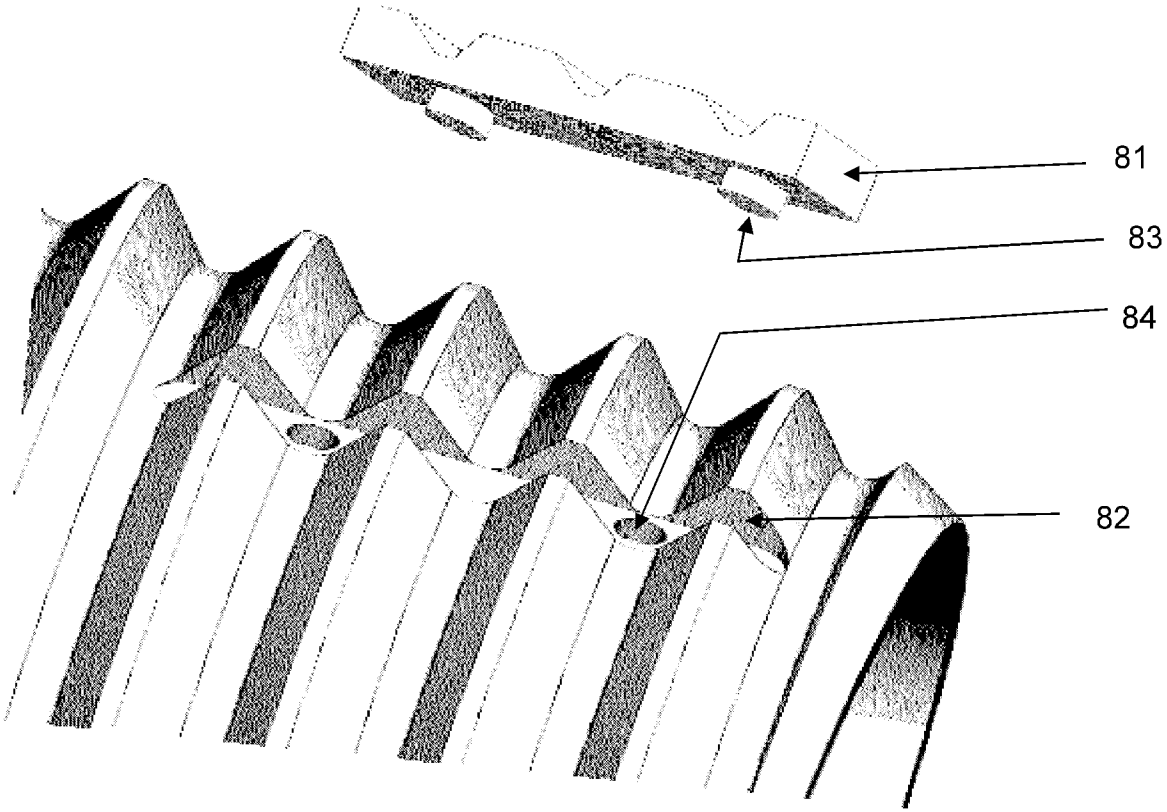
FIG. 8 shows an alternative embodiment of an insert and slot.

It is also apparent that there could beneficially be more slots and inserts disposed along the length of either or both male and female tapered sections and contributing to the spatial separation of the threads 23 of both sections. There can be many variations of the insert design. For instance, FIG. 8 shows an insert 81 that is located axially along the slot(s) 82 by cylindrical protrusions 83 along the lower surface of the insert that locate into corresponding blind holes 84 drilled into the tapered section. As shown in FIG. 8 the thread root sections of insert 81 will align with the thread crests of the corresponding female tapered section, and provide both radial and axial separation of both sections, thereby allowing a generally equal annular gap along the threads in which the thermoplastic can be injected.

Figure 9:
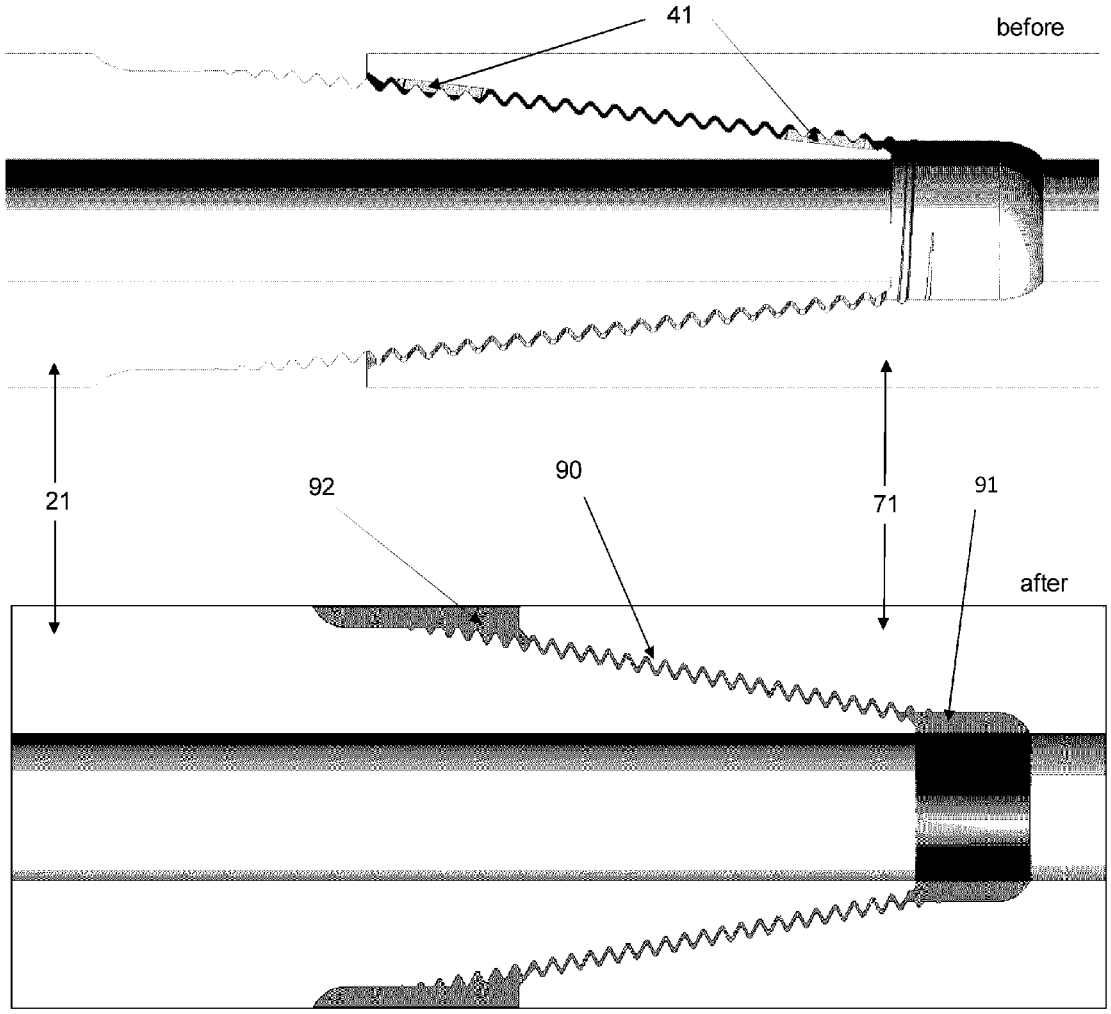
FIG. 9 shows the fully equidistant spacing between male section and female section cylinders is determined by the insert dimensions when the two metal sections of the EM gap sub are fully engaged, the views being before and after plastic injection.

FIG. 9 shows two depictions of cross-section cut-away views of an assembled EM gap sub, both before plastic injection and after. The 'before' figure shows the generally equally-disposed spaces between the thread surfaces. Also shown is the simple, mechanically-dimensioned design of the two tapered sections. These sections are unable to directly touch due to the offset caused by the interference of the inserts 41 when fully inserted. The disposition of the inserts also coaxially aligns the tapered sections as one is threaded within the other. The 'after' figure shows how the plastic injection process fills the annular space between threads 90 as well as internal 91 and external 92 spaces appropriate for a practical EM gap sub, this feature being dependent on the features of the mould holding the male section 21 and the female section 71, as would be implemented in a straightforward manner by one reasonably skilled in the art.

It will be evident that the torque necessary to thread these cylinders together will slowly increase as they are engaged, and suddenly increase as the tapers reach a point where they can only thread further into one another by significantly deforming the inserts. It is at this point that the threading process is halted, ensuring that the mutual alignment and full engagement process is complete. Thus the minimum strength of the inserts is the amount necessary to resist deformation under assembly torque, and that necessary to support the weight of one cylinder carrying the other while retaining coaxial alignment prior to being held within the injection moulding machine. Some ductility in the inserts would be an advantage in order that machining imperfections do not unduly deform one insert with respect to one or more of the others, thereby spoiling uniform alignment and relatively equal thread spacing. Suitable plastics include nylon, polyethylene terephthalate (PET) and polyvinylchloride (PVC).

A further embodiment of the concept is that the inserts must be strong enough as a group to resist the large forces due to the thermoplastic injection pressure. This feature avoids the otherwise necessary need for mechanical fixturing complications employing relatively costly restraint features, such as grooves on the outer walls of both cylinders that must mate (with a risk of galling) with complementary features on the mould, or internal locating rods or suchlike that enable the axial placement of one cylinder with respect to the other when within a mould such that the thread faces are caused to remain at substantially the same distance from each other.

Once the tapered sections have been permanently joined by the thermoplastic injection, the insulation gap spacing and integrity depends primarily on the mechanical properties of the thermoplastic. The taper structure design will ideally incorporate a coarse thread, a relatively large surface area relative to the annular volume, and a relatively small gap from one tapered cylinder thread surface to the other. Under drilling operations these features will enable the thermoplastic to better resist drillstring compression, tension and bending loads, and torque across the gap sub via frictional means acting across the metal/thermoplastic/metal interfaces, such as taught by the Goodner '787 Patent. It will be understood that for exemplary purposes we have described an assembly means and method of building an EM gap sub with two sets of three inserts equally disposed at the distal and proximal ends of the threaded sections. To one reasonably skilled in the art it will now be apparent this innovation anticipates the many other possible insert configurations that would have the capability of producing the alignment described herein. For instance, one could advantageously consider disposing other inserts at various places along the taper, placing inserts at orientations other than axial, on slots along the female taper, on slots on both tapers, inserts that are longer, shorter or differently shaped from that disclosed herein, inserts made of non-conducting material other than thermoplastic (such as fibreglass, hard rubber, composites, . . . ), a different number of inserts at the proximal end compared to the distal end of a threaded section etc.

Having thus described the invention, what is claimed as new and desired to be secured by Letters Patent is:

1. An electromagnetic (EM) isolation gap sub telemetry apparatus for use in well drilling and production in conjunction with a drilling rig including a derrick, the apparatus comprising:

a first electrically conductive cylindrical member including a tapered, male-threaded portion with thread roots and crests;

a second electrically conductive cylindrical member including a tapered, female-threaded portion with thread roots and crests adapted for receiving the male-threaded portion of said first electrically conductive cylindrical member;

a plurality of non-conductive inserts adapted for preventing direct physical contact between said male-threaded portion and female-threaded portion when the first electrically conductive cylindrical member is threaded with said second electrically conductive cylindrical member, thereby forming an annular gap between said first and second electrically conductive cylindrical members;

each said non-conductive insert including an axial runner and multiple thread form extensions extending laterally from said axial runner;

each said thread form extension including a pair of downwardly-converging walls forming an upwardly-open, V-shaped configured for placement within a respective thread root;

a plurality of axial cuts disposed at intervals around the diameter of the tapered section of either the male-threaded portion, or the female-threaded portion, or both, thereby forming axial slots;

wherein said plurality of non-conductive insert runners are placed within said axial slots with their respective extensions placed within respective thread roots on both sides of said axial slot; and said annular gap between said first and second electrically conductive cylindrical members configured for optimal non-contacting alignment between said members prior to permanent attachment being made by injecting epoxy in said annular gap.

2. The apparatus of claim 1, further including:

at least two sets of at least three axial cuts extending through respective thread crests disposed at intervals around the diameter of the tapered section of either the male-threaded portion, or the female-threaded portion, or both, thereby forming axial slots; and wherein said plurality of non-conductive inserts are placed within said axial slots.

3. The apparatus of claim 2, further including:

the male-threaded portion of the first electrically conductive cylindrical member having proximal and distal ends; and wherein one set of said axial slots is located at substantially the proximal, distal, or both ends of the tapered section.

4. The apparatus of claim 1, further including:

at least one spirally-wound cut disposed around the diameter of the tapered section of either the male threaded-portion, or the female-threaded portion, or both, thereby forming spirally-wound slots; and wherein a plurality of said non-conductive inserts are placed within said spirally-wound slots.

5. A method of monitoring and recording various drilling parameters produced during well drilling and production in conjunction with a drilling rig including a derrick, the method comprising the steps:

providing a drill string comprising a plurality of connected tubular drill pipe members;

providing a BHA including an EM gap sub and telemetry apparatus adapted for encoding and transmitting EM signals, a mud motor, and a drill bit;

attaching said BHA to the bottom of said drill string;

providing an EM gap located within said drill string;

providing an insulation gap located within said EM gap;

providing a surface antenna located in the ground a suitable distance away from the derrick;

providing a receiver for receiving encoded EM signals;

providing and amplifier for amplifying said encoded EM signals;

providing a decoder for decoding said EM signals;

providing a display device for displaying said EM signals;

powering said drill bit with said mud motor, thereby advancing said drill string and producing drilling parameters;

detecting drilling parameters with said EM gap sub and telemetry apparatus;

electrically producing an EM carrier across said insulation gap;

encoding said drilling parameters using said EM gap sub and telemetry apparatus onto said EM carrier, thereby creating an EM signal;

detecting said EM signal at the surface by measuring the signal formed between the rig's derrick and the surface antenna;

amplifying said EM signal using said amplifier;

decoding said EM signal using said decoder;

displaying said drilling parameters to the drill operator using said display device;

wherein said EM gap sub and telemetry device comprises:

a first electrically conductive cylindrical member including a tapered, male-threaded portion;

a second electrically conductive cylindrical member including a tapered, female-threaded portion adapted for receiving the male-threaded portion of said first electrically conductive cylindrical member; and a plurality of non-conductive inserts adapted for preventing direct physical contact between said male-threaded portion and female-threaded portion when the first electrically conductive cylindrical member is threaded with said second electrically conductive cylindrical member, thereby forming an annular gap between said first and second electrically conductive cylindrical members;

each said non-conductive insert including an axial runner and multiple thread form extensions extending laterally from said axial runner;

each said thread form extension including a pair of downwardly-converging walls forming an upwardly-open, V-shaped configured for placement within a respective thread root;

a plurality of axial cuts disposed at intervals around the diameter of the tapered section of either the male-threaded portion, or the female-threaded portion, or both, thereby forming axial slots;

wherein said plurality of non-conductive insert runners are placed within said axial slots with their respective extensions placed within respective thread roots on both sides of said axial slot; and said annular gap between said first and second electrically conductive cylindrical members configured for optimal non-contacting alignment between said members prior to permanent attachment being made by injecting epoxy in said annular gap.

* * * * *